US009041273B2

(12) United States Patent
Burrows et al.

(10) Patent No.: US 9,041,273 B2
(45) Date of Patent: May 26, 2015

(54) CORONA IGNITER HAVING SHAPED INSULATOR

(75) Inventors: John Antony Burrows, Northwich (GB); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 405 days.

(21) Appl. No.: 13/325,362

(22) Filed: Dec. 14, 2011

(65) Prior Publication Data

US 2012/0181916 A1 Jul. 19, 2012

Related U.S. Application Data

(60) Provisional application No. 61/422,833, filed on Dec. 14, 2010.

(51) Int. Cl.
*H01T 13/20* (2006.01)
*H01T 13/50* (2006.01)

(52) U.S. Cl.
CPC ..... *H01T 13/50* (2013.01)

(58) Field of Classification Search
CPC ..... H01T 13/32; H01T 13/36; H01T 21/02; H01T 13/52; H01T 13/00; H01T 13/20
USPC ..... 313/118, 141, 142, 143, 144; 445/7
See application file for complete search history.

(56) References Cited

U.S. PATENT DOCUMENTS 1,164,082 A 12/1915 Batchelder et al.
1,216,139 A 2/1917 Kopf
1,375,851 A 4/1921 Leich
1,742,784 A 1/1930 Rabezzana
1,852,265 A 4/1932 Rohde (Continued)

FOREIGN PATENT DOCUMENTS

CN 101292403 10/2008
EP 0913897 9/1998

(Continued)

OTHER PUBLICATIONS

International Search Report mailed Mar. 14, 2012 (PCT/US2011/064784).

*Primary Examiner* — Anne Hines
*Assistant Examiner* — Kevin Quarterman
(74) *Attorney, Agent, or Firm* — Robert L. Stearns; Dickinson Wright PLLC

(57) ABSTRACT

A corona igniter (20) for emitting a radio frequency electric field and providing a corona discharge (24) includes a central electrode (22) at a positive voltage, a grounded metal shell (30), and an insulator (28) with an abruption (34) extending radially outward relative to the central electrode (22). The abruption (34) is typically an increase of at least 15% of a local thickness (t) of the insulator (28) over less than 25% of a nose length (el) of an insulator nose region (74). The abruption (34) is typically one flank (82) of a protrusion or a notch, and the flank (82) faces the shell (30). The abruption (34) reverses the electric field and voltage potential gradient along the insulator outer surface (32), repels charged ions away from the insulator (28), and thus prevents the formation of a conductive path between the central electrode (22) and the shell (22).

21 Claims, 7 Drawing Sheets

(56) References Cited

U.S. PATENT DOCUMENTS

| | | | | |
|---|---|---|---|---|
| 2,353,620 | A | 7/1944 | Wenerth | |
| 4,211,952 | A * | 7/1980 | Iwata et al. | 313/143 |
| 5,950,585 | A | 9/1999 | Sarcarto | |
| 6,472,801 | B1 * | 10/2002 | Matsubara et al. | 313/141 |
| 6,628,050 | B1 * | 9/2003 | Kameda et al. | 313/143 |
| 6,883,507 | B2 | 4/2005 | Freen | |
| 7,741,761 | B2 | 6/2010 | Jaffrezic et al. | |
| 2002/0079800 | A1 * | 6/2002 | Miyashita et al. | 313/143 |
| 2007/0069617 | A1 * | 3/2007 | Tozzi et al. | 313/140 |
| 2008/0093965 | A1 * | 4/2008 | Takada et al. | 313/143 |
| 2008/0284303 | A1 | 11/2008 | Agneray et al. | |
| 2009/0033194 | A1 | 2/2009 | Jaffrezic et al. | |
| 2010/0083942 | A1 | 4/2010 | Lykowski et al. | |
| 2010/0175653 | A1 | 7/2010 | Lykowski et al. | |
| 2010/0175655 | A1 | 7/2010 | Lykowski et al. | |
| 2010/0282197 | A1 | 11/2010 | Permuy et al. | |
| 2011/0146640 | A1 | 6/2011 | Achstaetter et al. | |
| 2012/0133264 | A1 * | 5/2012 | Morin | 313/141 |

FOREIGN PATENT DOCUMENTS

| | | | |
|---|---|---|---|
| FR | 2 859 831 | A1 | 9/2012 |
| JP | 57186066 | A | 11/1982 |

* cited by examiner

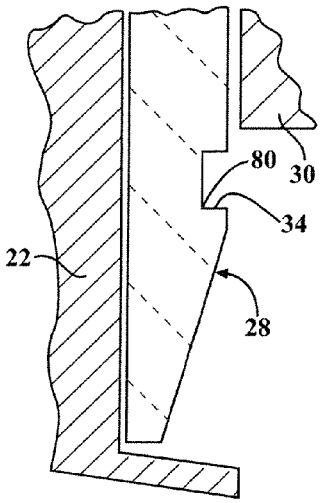
FIG. 5J
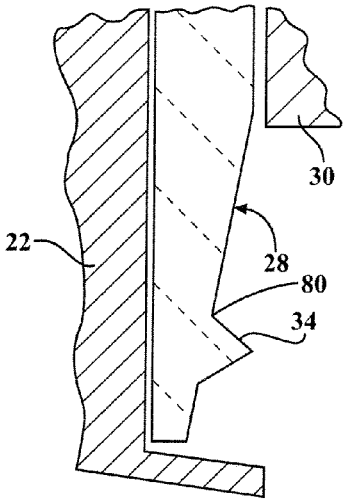
FIG. 5K
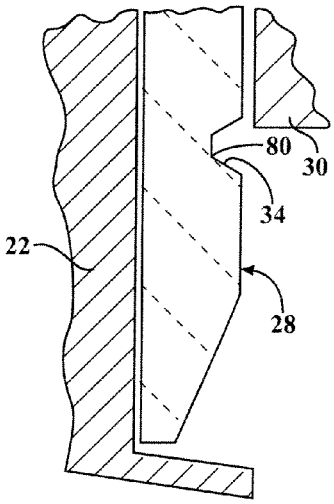
FIG. 5L
FIG. 6A
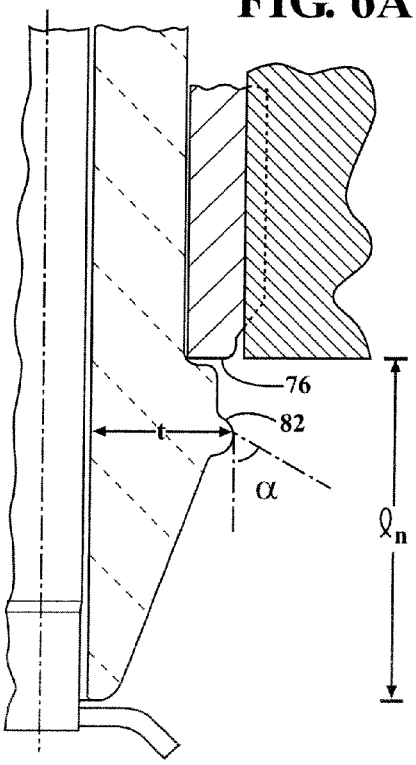
FIG. 6B
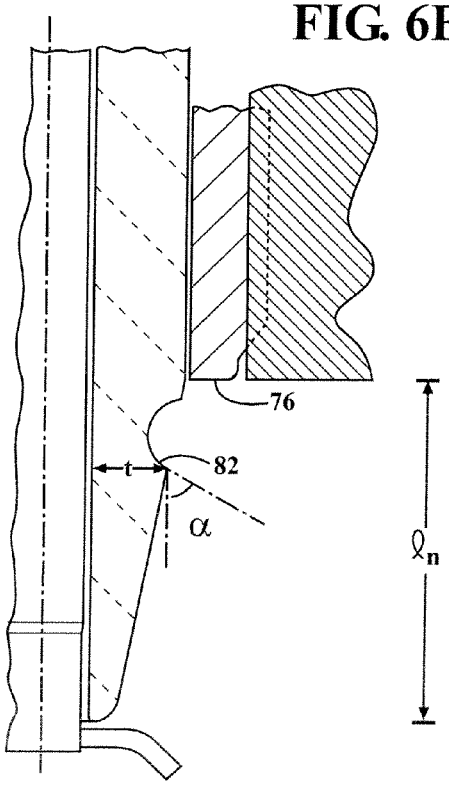

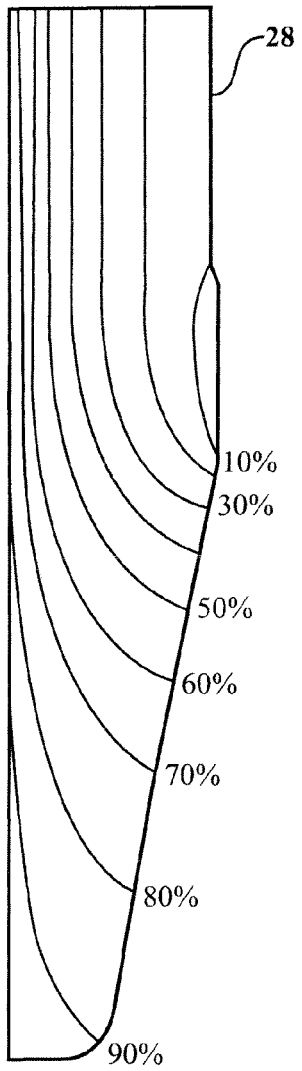
FIG. 7
FIG. 8
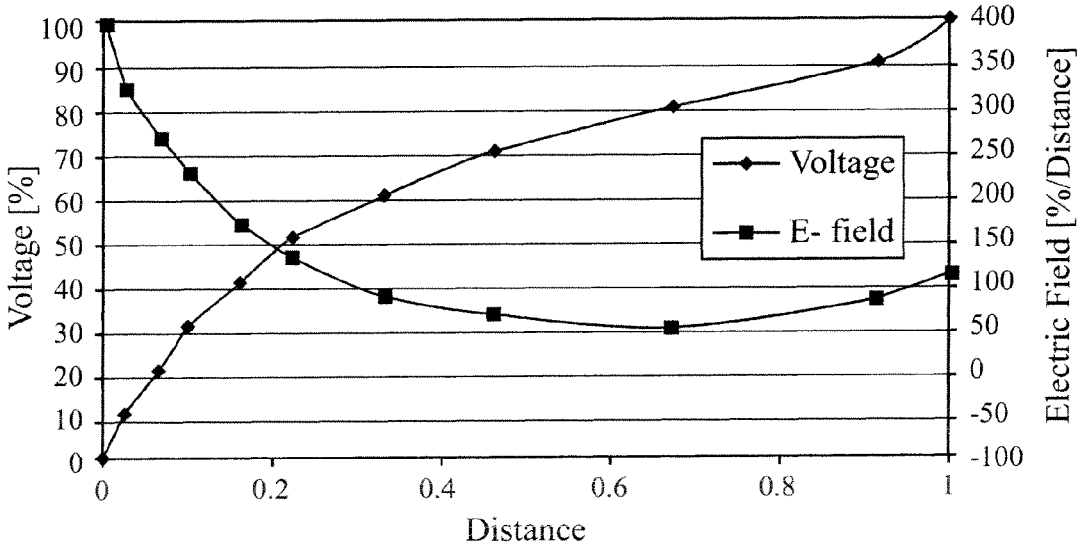

CORONA IGNITER HAVING SHAPED INSULATOR

CROSS REFERENCE TO RELATED APPLICATION

This application claims the benefit of application U.S. Provisional Application Ser. No. 61/422,833, filed Dec. 14, 2010.

BACKGROUND OF THE INVENTION

1. Field of the Invention

This invention relates generally to a corona igniter for emitting a radio frequency electric field to ionize a fuel-air mixture and provide a corona discharge, and a method of forming the igniter.

2. Description of the Prior Art

Corona discharge ignition systems include an igniter with a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The corona igniter typically includes the central electrode formed of an electrically conductive material for receiving the high radio frequency voltage and emitting the radio frequency electric field to ionize the fuel-air mixture and provide the corona discharge. The igniter also includes a shell formed of a metal material receiving the central electrode and extending longitudinally from an upper shell end to a lower shell end. An insulator formed of an electrically insulating material is disposed in the shell and surrounds the central electrode. The igniter of the corona discharge ignition system does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2010/0083942 to Lykowski and Hampton.

During operation of the corona igniter, when the central electrode is at a maximum possible positive voltage, such as a 100% voltage, and the shell is grounded at the lowest possible voltage, such as a 0% voltage, an ionized gas is formed in a gap between the insulator and the shell. Under certain conditions, a very high electric field strength exists in the gap. Negative ions of the ionized gas typically follow a voltage potential gradient and electric field over the surface of the insulator to the central electrode, forming a conductive path from the shell to the central electrode. The ionized gas is also formed in a gap between the central electrode and insulator, and an identical situation exists, except with the charges, voltages, and currents reversed. The conductive path between the central electrode and shell can create undesirable power-arcing and deplete the remaining corona discharge, which can degrade the quality of ignition.

SUMMARY OF THE INVENTION

One aspect of the invention provides a corona igniter for emitting a radio frequency electric field to ionize a fuel-air mixture and provide a corona discharge. The corona igniter comprises a central electrode formed of an electrically conductive material for receiving the high radio frequency voltage and emitting the radio frequency electric field to ionize the fuel-air mixture and provide the corona discharge. A shell formed of a metal material extends along the central electrode and longitudinally from an upper shell end to a lower shell end. An insulator formed of an electrically insulating material is disposed between the central electrode and the shell. The insulator includes an insulator outer surface facing away from the central electrode and extending longitudinally from an insulator upper end to an insulator nose end. The insulator outer surface presents an abruption extending radially outward relative to the central electrode.

Another aspect of the invention provides a method of forming a corona igniter. The method includes the step of providing an insulator formed of an electrically insulating material, which includes an insulator inner surface presenting an insulator bore and an oppositely facing insulator outer surface, each extending longitudinally from an insulator upper end to an insulator nose end. The insulator is also provided to include an insulator nose region adjacent the insulator nose end, and the insulator outer surface of the insulator nose region presents an abruption extending radially outward relative to the insulator bore. The method next includes disposing a central electrode formed of an electrically conductive material in the insulator bore. The method further includes providing a shell formed of a metal material and including an inner shell surface presenting a shell bore extending longitudinally form a lower shell end to an upper shell end, and disposing the insulator in the shell bore.

During operation of the corona igniter of the present invention, an ionized gas with a high electric field strength is formed in a gap between the insulator and the shell, and the negative ions may begin to travel along the insulator. However, before the negative ions reach the central electrode, the abruption reverses the electric field and voltage potential gradient along the insulator outer surface and repels the negative ions. The negative ions do not travel to an area along the insulator having a decreasing voltage, which would be along the abruption and past the abruption. Rather, the repelled negative ions may combine with positive ions in the air surrounding the insulator. Thus, the abruption prevents the negative ions from reaching the central electrode and forming a conductive path from the shell to the central electrode, which typically creates undesirable power-arcing and depletes the corona discharge being emitted from the electrode into the combustion chamber. The abruption also creates a blockage of the electrical path along the insulator outer surface between the shell and the central electrode. The abruption may also prevent power-arcing by repelling positive ions traveling along the insulator from the central electrode to the shell, in the same manner as the negative ions. The abruption of the insulator preserves a robust corona discharge and provides a higher quality ignition, compared to igniters without the abruption.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 6A illustrates a flank and flank angle provided by an abruption according to one embodiment of the invention;

FIG. 6B illustrates a flank and flank angle provided by an abruption according to another embodiment of the invention;

FIG. 7 is an enlarged cross-section view of an insulator of the prior art showing a typical pattern of electrical potential; and FIG. 8 is a plot of the electric field and voltage potential gradient of the prior art insulator of FIG. 7.

DETAILED DESCRIPTION

Figure 1:
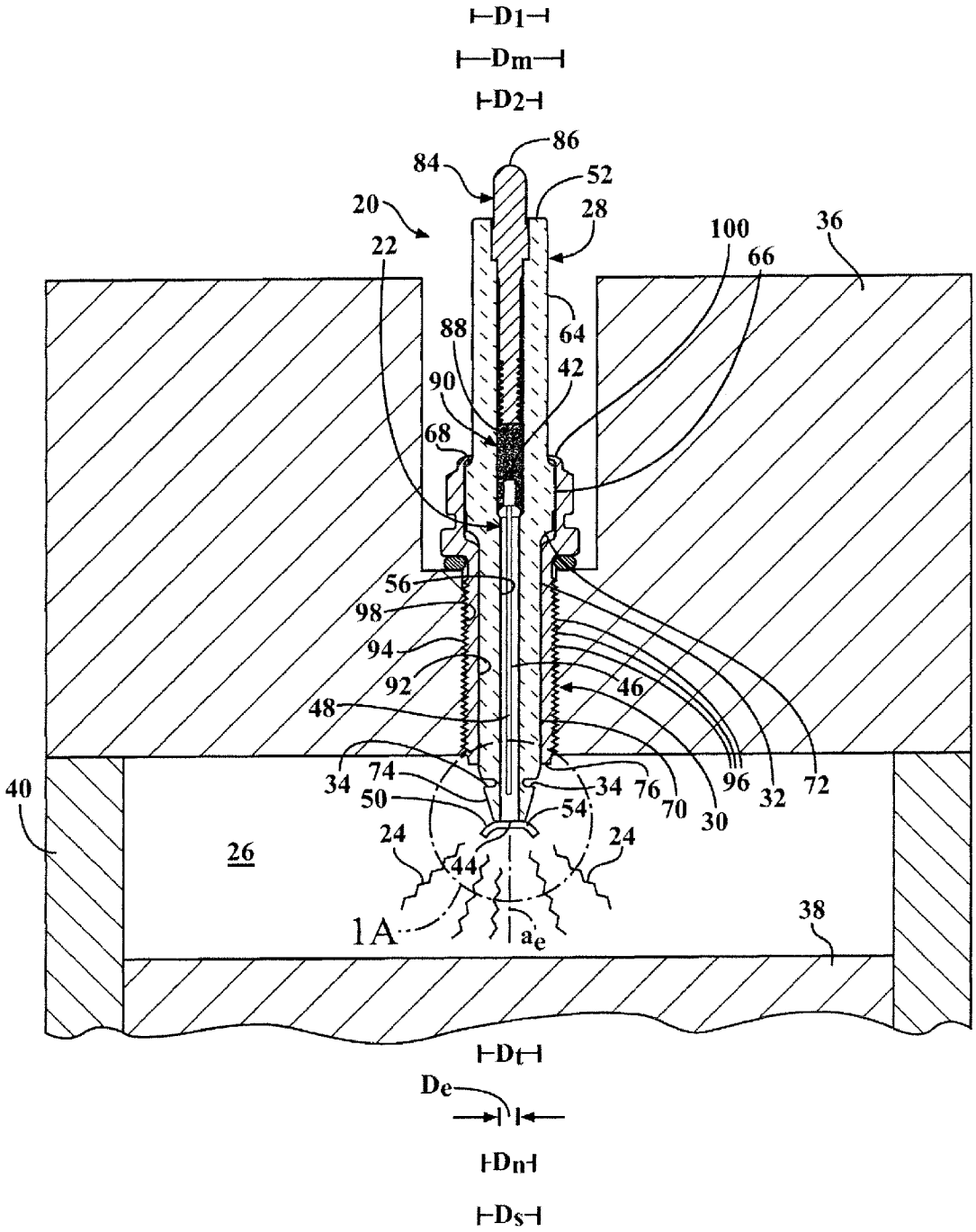
FIG. 1 is a cross-sectional view of a corona igniter disposed in a combustion chamber according to one aspect of the invention.

One aspect of the invention provides a corona igniter 20 for a corona discharge ignition system. The igniter 20 includes a central electrode 22 for receiving a high radio frequency voltage and emitting a radio frequency electric field to ionize a portion of a fuel-air mixture and provide a corona discharge 24 in a combustion chamber 26 of an internal combustion engine. The corona igniter 20 includes an insulator 28 receiving the central electrode 22 and surrounded by a metal shell 30. The insulator 28 includes an insulator outer surface 32 presenting an abruption 34 extending radially outward relative to the central electrode 22. The abruption 34 is an increase in a local thickness t of the insulator 28 in a direction moving from the shell 30 toward an insulator nose end 54, which is typically provided by a notch or a protrusion. The abruption 34 repels positive and negative ions away from the insulator 28, between the shell 30 and the central electrode 22. The abruption 34 also creates a blockage of the electrical path along the insulator outer surface 32 between the shell 30 and the central electrode 22 to sustain the corona discharge 24 and prevent power-arcing between the shell 30 and the central electrode 22.

In one embodiment, as shown in FIG. 1, the corona igniter 20 is disposed in a cylinder head 36 and spaced from a piston 38 of the internal combustion engine. The cylinder head 36, a cylinder block 40, and the piston 38 together provide the combustion chamber 26 for containing the fuel-air mixture, and the corona igniter 20 extends into the combustion chamber 26.

The central electrode 22 of the corona igniter 20 has an electrode center axis $a_e$ extending longitudinally from an electrode terminal end 42 for receiving the high radio frequency voltage to an electrode firing end 44. The central electrode 22 includes an electrode body portion 46 formed of a first electrically conductive material, such as nickel or nickel alloy, extending longitudinally from the electrode terminal end 42 along the electrode center axis $a_e$ to the electrode firing end 44. During operation of the igniter 20 when the central electrode 22 receives the high radio frequency voltage, the central electrode 22 has a high voltage, typically 1,000 to 100,000 volts.

Figure 1A:
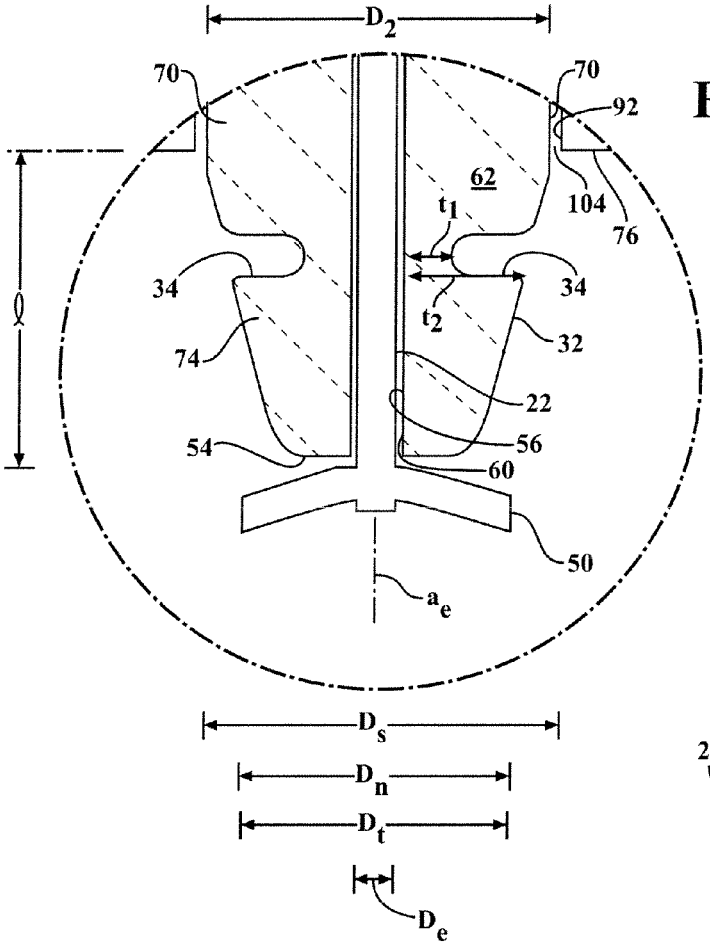
FIG. 1A is an enlarged cross-section view of a firing end of the corona igniter of FIG. 1.

As shown in FIG. 1, the central electrode 22 includes a firing tip 50 at the electrode firing end 44 for emitting the radio frequency electric field to ionize a portion of the fuel-air mixture in the combustion chamber 26 and provide the corona discharge 24. The firing tip 50 is formed of a second electrically conductive material and also has the high voltage. In one preferred embodiment, the second electrically conductive material includes at least one element selected from Groups 4-12 of the Periodic Table of the Elements. The firing tip 50 has a tip diameter $D_t$ and the electrode body portion 46 has an electrode diameter $D_e$ each being perpendicular to the electrode center axis $a_e$. The tip diameter $D_t$ is typically greater than the electrode diameter $D_e$ of the electrode body portion 46, as shown in FIGS. 1 and 1A.

The insulator 28 of the corona igniter 20 is disposed annularly around and longitudinally along the electrode body portion 46 and extends from an insulator upper end 52 to an insulator nose end 54. The insulator nose end 54 is adjacent the electrode firing end 44 and abuts the firing tip 50. The insulator 28 includes an insulator inner surface 56 presenting an insulator bore extending longitudinally along the electrode center axis $a_e$ from the insulator upper end 52 to the insulator nose end 54. The insulator inner surface 56 faces the central electrode 22 and the insulator bore receives the central electrode 22. As shown in FIG. 1A, the insulator inner surface 56 and the central electrode 22 present an electrode gap 60 therebetween. The insulator 28 also includes an insulator outer surface 32 opposite the insulator inner surface 56 extending longitudinally along the electrode center axis $a_e$ from the insulator upper end 52 to the insulator nose end 54 and facing outwardly toward the shell 30 and away from the central electrode 22.

The insulator 28 includes a matrix 62 of electrically insulating material extending continuously from the insulator inner surface 56 to the insulator outer surface 32. The electrically insulating material has a relative permittivity greater than the relative permittivity of air, in other words greater than 1. In one embodiment, the electrically insulating material is alumina and has a relative permittivity of about 9. In another embodiment, the electrically insulating material is boron nitride and has a relative permittivity of about 3.5. In yet another embodiment, the insulating material is silicon nitride and has a relative permittivity of about 6.0

As shown in FIG. 1, the insulator 28 includes an insulator first region 64 extending along the electrode body portion 46 from the insulator upper end 52 toward the insulator nose end 54. The insulator first region 64 presents an insulator first diameter $D_1$ extending generally perpendicular to the longitudinal electrode body portion 46 and an insulator middle region 66 adjacent the insulator first region 64 extending toward the insulator nose end 54. An insulator upper shoulder 68 extends radially outwardly from the insulator first region 64 to the insulator middle region 66. The insulator middle region 66 presents an insulator middle diameter $D_m$ extending generally perpendicular to the longitudinal electrode body portion 46, which is greater than the insulator first diameter $D_1$.

The insulator 28 also includes an insulator second region 70 adjacent the insulator middle region 66 extending toward the insulator nose end 54. The insulator 28 includes an insulator lower shoulder 72 extending radially inwardly from the insulator middle region 66 to the insulator second region 70. The insulator second region 70 presents an insulator second diameter $D_2$ extending generally perpendicular to the longitudinal electrode body portion 46, which is typically equal to the insulator first diameter $D_1$ and less than the insulator middle diameter $D_m$.

The insulator 28 includes an insulator nose region 74 extending from the insulator second region 70 to the insulator nose end 54. The insulator nose region 74 presents an insulator nose diameter $D_n$ extending generally perpendicular to the longitudinal electrode body portion 46 and tapering to the insulator nose end 54. As shown in FIG. 1A, the insulator nose diameter $D_n$ is typically less than the insulator second diameter $D_2$, and it is also less than the tip diameter $D_t$ of the firing tip 50 at the insulator nose end 54. However, in an alternate embodiment, the insulator nose diameter $D_n$ is greater than or equal to the insulator second diameter $D_2$. The insulator nose region 74 also has a nose length el extending longitudinally from the insulator second region 70 adjacent the lower shell end 76 to the insulator nose end 54.

Figure 3:
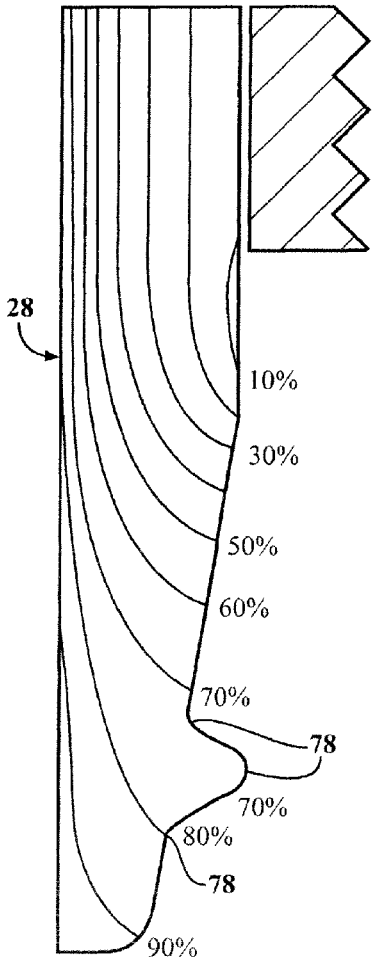
FIG. 3 is an enlarged cross-section view of an insulator according to another embodiment of the invention showing a typical pattern of electric potential.

The insulator outer surface 32 of the insulator nose region 74 presents the abruption 34, which prevents the undesirable arc discharge and sustains a robust corona discharge 24. The abruption 34 extends radially outwardly away from the central electrode 22 and is an increase in the local thickness t of the insulator 28 in a direction moving from the shell 30 toward the insulator nose end 54. The local thickness t of the insulator 28 is equal to the distance between the insulator inner surface 56 and the insulator outer surface 32 at one point along the insulator 28. The abruption 34 is typically provided by a flank 82, face, or surface facing toward the shell 30. As shown in FIGS. 1, 3, and 5, the abruption 34 is preferably disposed longitudinally between the lower shell end 76 and the insulator nose end 54. In one embodiment, the abruption 34 extends circumferentially around the entire insulator nose region 74. In another embodiment, the abruption 34 extends around a portion of the circumference of the insulator 28. The insulator 28 typically includes one of the abruptions 34, but may include a plurality of the abruptions 34. In one embodiment, the insulator 28 includes two abruptions 34, one on each opposing side of the insulator 28.

The abruption 34 is provided by an increase in the local thickness t of the insulator, which typically is an increase in the insulator nose diameter $D_n$ over the nose length el of the insulator 28 in a direction moving from the shell 30 toward an insulator nose end 54. In one embodiment, the abruption 34 is provided by an increase of at least 15% in the insulator local thickness t, wherein the increase occurs over less than 25% of the nose length el. An example of the increase in local thickness t of the insulator 28 is shown in FIG. 1A, where the insulator 28 increases from a first thickness at $t_1$ to a second thickness at $t_2$, wherein the local thickness at $t_1$ is at least 15% greater than the local thickness at $t_2$. In another embodiment, the abruption 34 is provided by an increase in the local thickness t of at least 25%, or at least 30%, or at least 35%, wherein the increase occurs over less than 25% of the nose length el.

The abruption 34 may be provided by one face or flank 82 of a notch, as shown in FIG. 1. The notch extends radially inwardly toward the central electrode 22. The notch is spaced from the lower shell end 76 and is provided by a decrease in the local thickness t of the insulator 28 followed by an increase in the local thickness t of the insulator 28 by at least 15%. The increase in local thickness t occurs over less than 25% of the nose length el. In this embodiment, the insulator nose diameter $D_n$ decreases from adjacent the lower shell end 76 to the abruption 34, decreases adjacent the abruption 34, increases at the abruption 34, and decreases gradually again from the abruption 34 to the insulator nose end 54.

In another embodiment, the abruption 34 is provided by one face or flank 82 of a protrusion extending radially outwardly away from the central electrode 22 and into the combustion chamber 26, as shown in FIG. 3. The protrusion is also spaced from the lower shell end 76 and is provided by an increase in the local thickness t by at least 15% followed by a decrease in the local thickness t. The increase in the local thickness t occurs over less than 25% of the nose length el. In this embodiment, the insulator nose diameter $D_n$ decreases from adjacent the lower shell end 76 to the abruption 34, increases at the abruption 34, and then decreases gradually again from the abruption 34 to the insulator nose end 54.

The abruption 34 can comprise a various designs, for example the designs shown in FIGS. 1, 3, and 5. In several embodiments, such as the embodiments of FIGS. 1 and 3, the insulator outer surface 32 includes smooth or curved transitions 78 providing the abruption 34. For example, the smooth transition 78 can be adjacent the abruption 34, along the abruption 34, or between the abruption 34 and the adjacent areas of the insulator outer surface 32. The notch of FIG. 1 is provided by convex transitions 78 from the area adjacent the notch and concave transitions 78 along the notch. The protrusion of FIG. 3 is provided by concave transitions 78 from the area adjacent the protrusion and a convex transition 78 along the protrusion.

In other embodiments, the insulator outer surface 32 includes a sharp edge 80 providing the abruption 34. For example, the sharp edge 80 can be adjacent the abruption 34, along the abruption 34, or between the abruption 34 and the adjacent areas of the insulator outer surface 32. In the embodiments of FIGS. 5A-5L, the insulator outer surface 32 includes at least one sharp edge 80 between the abruption 34 and the adjacent areas of the insulator outer surface 32. As shown in FIGS. 5A-5L, the notch or protrusion providing the abruption 34 can include a rectangular profile, or a triangular profile, or a concave profile along the insulator outer surface 32.

In one embodiment, the abruption 34 is the flank 82 along the insulator outer surface 32. The flank 82 faces generally toward the lower shell end 76 and is an increase of at least 15% in the local thickness t of the insulator 28 over less than 25% of the nose length el. The flank 82 presents a flank angle $\alpha$ that is preferably greater than a line of equipotential at the flank 82. Examples of the flank 82 presenting the flank angle $\alpha$ are shown in FIGS. 6A and 6B. The flank angle $\alpha$ is the steepest angle the flank 82 achieves. It is the angle between a hypothetical line aligned with the flank 82 at the greatest local thickness t and a hypothetical line parallel the electrode center axis $a_e$ at the greatest local thickness t if the flank 82. In one embodiment, the flank angle $\alpha$ is at least 30 degrees or at least 45 degrees.

In one embodiment, the abruption 34 is disposed closer to the shell 30 than the insulator nose end 54. In another embodiment, the abruption 34 is disposed closer to the insulator nose end 54 than the shell 30. In yet another embodiment, the abruption 34 is spaced equally from the shell 30 and the insulator nose end 54. The insulator nose region 74 typically decreases gradually from the abruption 34 to the insulator nose end 54.

In one embodiment, the insulator nose diameter $D_n$ including the abruption 34 is less than a shell bore diameter $D_s$ of the shell 30. This allows the igniter 20 to be formed by inserting the insulator nose end 54 through the shell 30, and then clamping the shell 30 about the insulator shoulders 68, 72. In another embodiment, the insulator nose diameter $D_n$ including the abruption 34 is greater than or equal to the shell bore diameter $D_s$, and the igniter 20 can be formed by inserting the insulator upper end 52 through the shell bore diameter D.

As shown in FIG. 1, the corona igniter 20 includes a terminal 84 received in the insulator 28 for being electrically connected to a terminal wire (not shown) at a first terminal end 86, and electrically connected to a power source (not shown). The terminal 84 is formed of an electrically conductive material and receives the high radio frequency voltage from the power source at the first terminal end 86 and transmits the high radio frequency voltage from the second terminal end 88 to the central electrode 22. The second terminal end 88 is electrically connected to the electrode terminal end 42. A sealing layer 90 formed of an electrically conductive material is disposed between and electrically connects the second terminal end 88 and the electrode terminal end 42 for providing the energy from the terminal 84 to the central electrode 22.

As shown in FIG. 1, the shell 30 is disposed in the cylinder head 36, annularly around the insulator 28. The shell 30 includes a inner shell surface 92 and an oppositely facing shell outer surface 94, which faces outwardly away from the insulator 28. In one embodiment, the shell outer surface 94 includes a plurality of threads 96 engaging an igniter slot 98 of the cylinder head 36 and securing the igniter 20 to the cylinder head 36.

The shell 30 is formed of a metal material, such as steel. The shell 30 extends longitudinally along the insulator 28 from an upper shell end 100 to a lower shell end 76. The lower shell end 76 is disposed at a border of the insulator second region 70 and the insulator nose region 74, such that the insulator nose region 74 projects outwardly of the lower shell end 76. The inner shell surface 92 faces the insulator 28 and presents a shell bore extending longitudinally along the electrode center axis $a_e$ from the upper shell end 100 to the lower shell end 76 for receiving the insulator 28. The shell bore presents a shell bore diameter $D_s$ extending generally perpendicular to the longitudinal electrode body portion 46. In one preferred embodiment, the shell bore diameter $D_s$ is greater than the insulator nose diameter $D_n$, as shown in FIG. 1A. The inner shell surface 92 and the insulator outer surface 32 present a shell gap 104 therebetween. The shell is typically bent around the insulator shoulders 68, 72, securing the shell 30 and insulator 28 together.

Figure 1B:
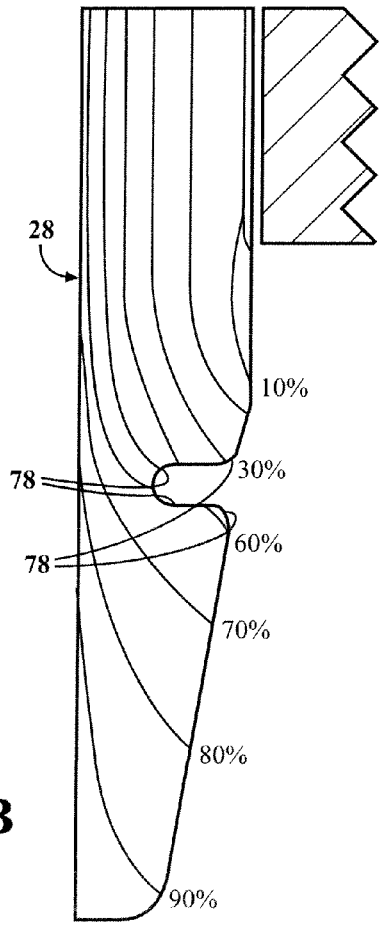
FIG. 1B is an enlarged cross-section view of an insulator of the corona igniter of FIG. 1 showing a typical pattern of electric potential.
Figure 2:
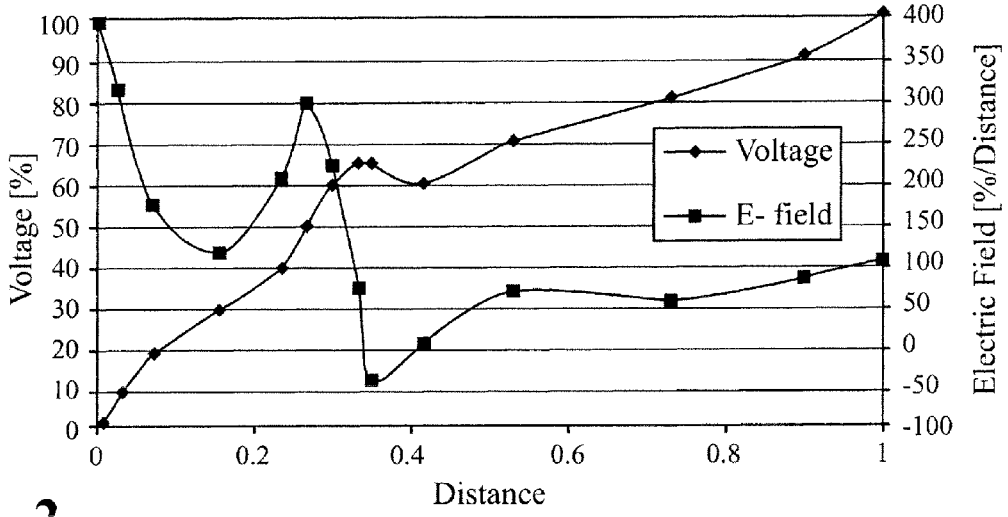
FIG. 2 is a plot of the electric field and voltage potential gradient of the insulator of FIG. 1.
Figure 4:
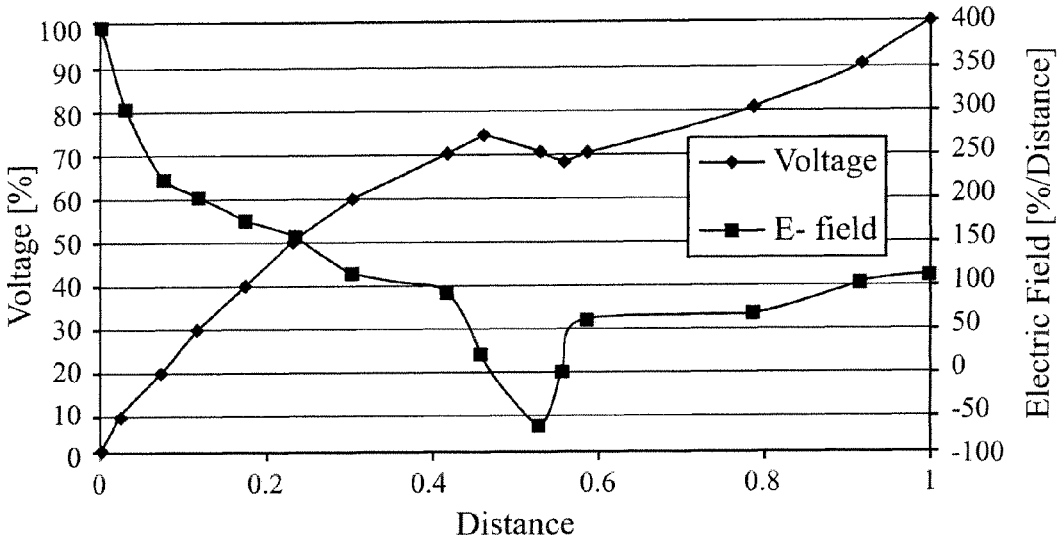
FIG. 4 is a plot of the electric field and voltage potential gradient of the insulator of FIG. 3.
Figures 5A, 5B, 5C:
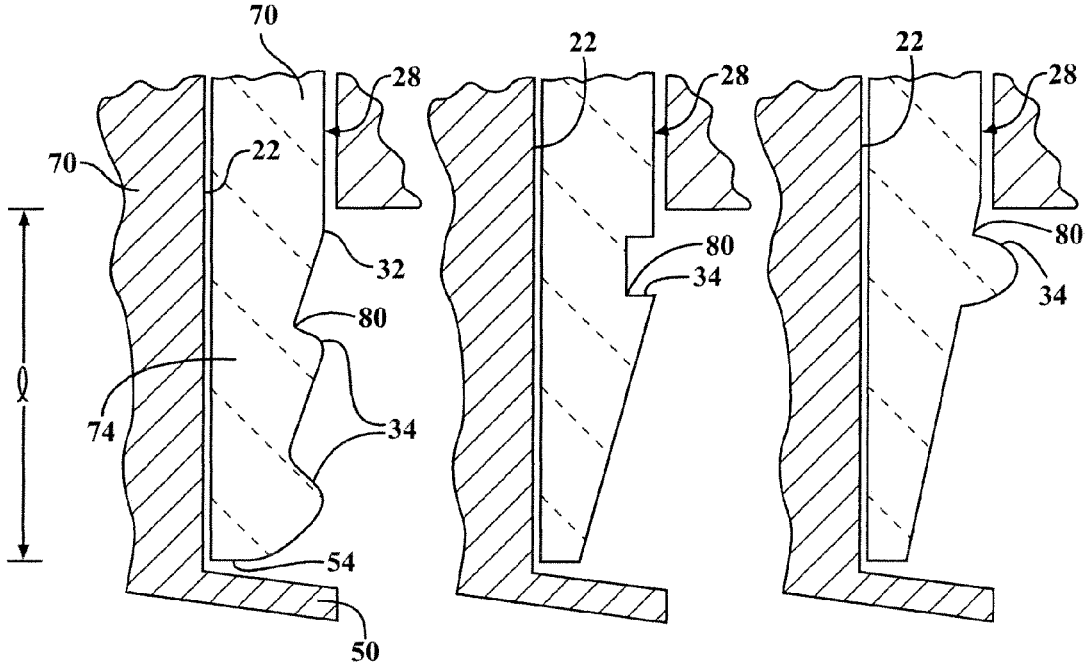
FIG. 5 includes cross-sectional views of example insulators according to other embodiments of the invention.
Figure 5D:
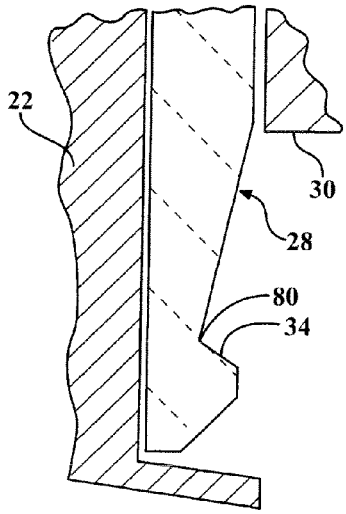
Figure 5E:
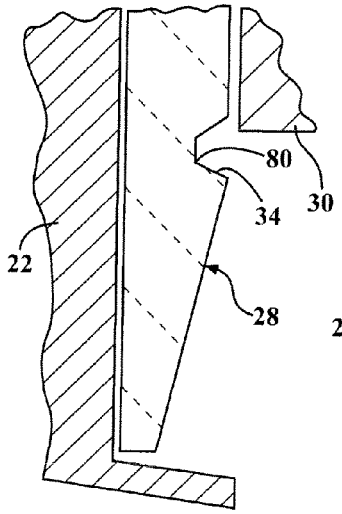
Figure 5F:
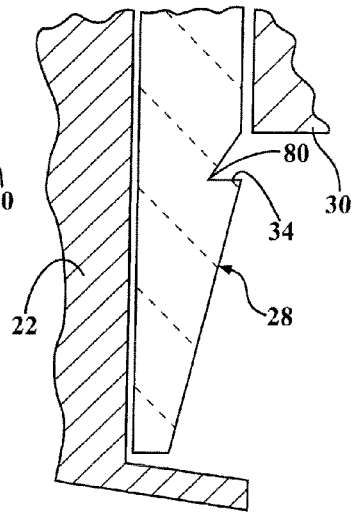
Figure 5G:
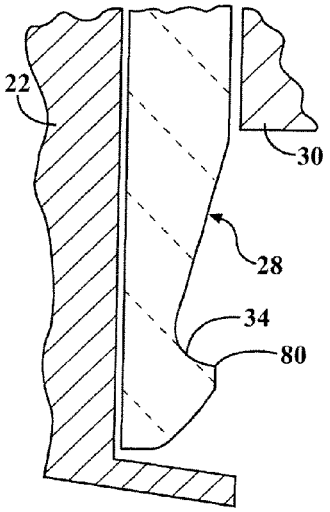
Figure 5H:
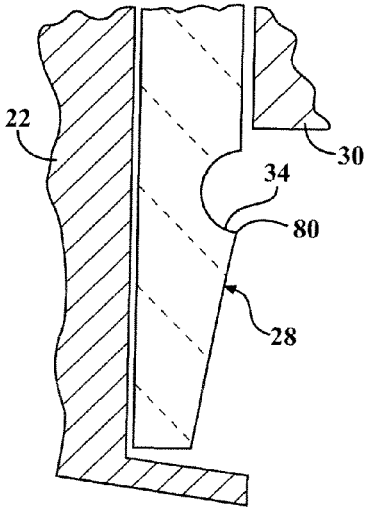
Figure 5I:
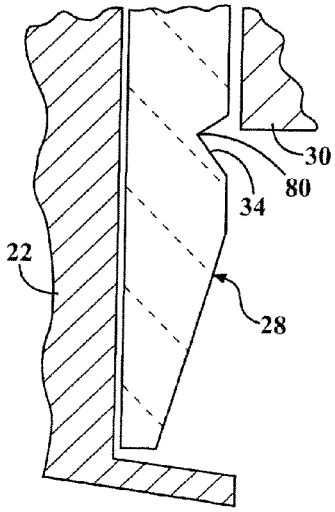

During operation of the igniter 20 in the internal combustion engine application, the high radio frequency voltage is provided to the central electrode 22, so that the central electrode 22 has a first voltage, typically 100 to 100,000 volts. The metal shell 30 is grounded and has a second voltage less than the first voltage, typically 0 volts. Thus, the shell gap 104 is filled with an ionized gas, including ions having positive and negative electric charges. The electrode gap 60 is also filled with the ionized gas during operation. Thus, an electric field and a voltage potential gradient forms along the insulator outer surface 32 and through the matrix 62 to the central electrode 22. FIGS. 1B and 3 illustrate a typical pattern of electrical potential in a section of the insulator 28, according to two embodiments of the invention. FIG. 2 is a plot of the electric field and voltage potential gradient of the insulator 28 of FIG. 1B, and FIG. 4 is a plot of the electric field and voltage potential of the insulator 28 of FIG. 3. The electric field and voltage potential gradient depend on the shape and location of the central electrode 22 and shell 30, and the permittivity and shape of the insulator 28.

During operation, for example during a moment in the electric cycle where the central electrode 22 is at a maximum possible positive voltage, such as a 100% voltage, and the shell 30 is grounded at the lowest possible voltage, such as a 0% voltage, the positive ions in the shell gap 104 can pass easily to the grounded shell 30. A portion of the negative ions of the shell gap 104 may combine with positive ions of the surrounding air of the combustion chamber 26. However, another portion of the negative ions in the shell gap 104 follow the voltage potential gradient over the insulator outer surface 32 toward the electrode firing end 44 of the central electrode 22. Before the negative ions reach the central electrode 22, the abruption 34 repels the negative ions away from the insulator 28 and allows them to combine with positive ions in the air surrounding the insulator 28. The negative ions do not travel to an area along the insulator nose region 74 having a reducing voltage, which would be along the abruption 34 and past the abruption 34. Thus, the abruption 34 prevents the negative ions from reaching the central electrode 22 and forming a conductive path from the shell 30 to the central electrode 22, which typically creates undesirable power-arcing and depletes the corona discharge 24 at the electrode firing end 44. The abruption 34 of the insulator 28 preserves a robust corona discharge 24 and provides a higher quality ignition compared to igniters without the abruption 34.

FIGS. 2 and 4 include plots illustrating the insulator 28 of the present invention has a voltage increasing steadily and continuously in a first direction over the insulator outer surface 32 longitudinally from adjacent the lower shell end 76 toward the insulator nose end 54, until reaching the abruption 34. The voltage of the insulator 28 then decreases in the first direction at the abruption 34.

The voltage of the insulator 28 presents a voltage potential gradient aligned in the first direction over the insulator outer surface 32 longitudinally from adjacent the lower shell end 76 toward the insulator nose end 54, until reaching the abruption 34. The abruption 34 reverses the voltage potential gradient. The voltage potential gradient is aligned in a second direction, reverse of the first direction, at the abruption 34.

While the high radio frequency voltage is provided to the central electrode 22, the insulator 28 also has an electric field. The electric field is aligned in a first direction radially from the insulator outer surface 32 through the matrix 62 and toward the central electrode 22, and longitudinally over the insulator outer surface 32 from adjacent the lower shell end 76 toward the insulator nose end 54. When the electric field of the insulator outer surface 32 reaches the abruption 34, the abruption 34 reverses the electric field. The electric field then becomes aligned in a second direction, reverse of the first direction, at the abruption 34.

Likewise, the positive ions in the electrode gap 60 follow the voltage potential gradient over the insulator outer surface 32 and through the matrix 62 toward the shell 30, with the charges, voltages, and currents reversed. The abruption 34 also repels the positive ions away from the insulator 28 and allows them to combine with negative ions in the air surrounding the insulator 28. The positive ions do not travel to an area along the insulator nose region 74 having a higher voltage, which would be along the abruption 34 and past the abruption 34. The abruption 34 prevents the positive ions from reaching the shell 30 and forming a conductive path from the central electrode 22 to the shell 30, which typically creates undesirable power-arcing and depletes the corona discharge 24 at the electrode firing end 44. Thus, the abruption 34 of the insulator 28 preserves a robust corona discharge 24 and provides a higher quality ignition compared to igniters without the abruption 34.

For comparison, FIG. 7 shows an insulator of the prior art without the abruption and a typical electrical potential of the insulator. FIG. 8 is a plot of the electric field and voltage potential gradient of the insulator of FIG. 7. The voltage of the insulator increases steadily and continuously in a first direction radially from the insulator outer surface to the central electrode, and also longitudinally over the insulator outer surface 32 from adjacent the lower shell end to the nose end. The voltage potential gradient also increases toward the central electrode and the electric field moves toward the central electrode.

Unlike the present invention, at least a portion of the negative ions of the shell gap follow the voltage potential gradient and electric field over the insulator outer surface and reach the central electrode. The negative ions form a conductive path from the shell to the central electrode and create undesirable power-arcing and deplete the corona discharge at the electrode firing end. Therefore, the insulator of the prior art does not preserve a robust corona discharge and provide a quality ignition to the extent provided by the subject invention.

Another aspect of the invention provides a method of forming the corona igniter 20. The method includes providing the insulator 28 formed of the electrically insulating material. The insulator 28 includes the insulator inner surface 56 presenting the insulator bore and the oppositely facing insulator outer surface 32 each extending longitudinally from the insulator upper end 52 to the insulator nose end 54. The method also includes providing the abruption 34 extending radially relative to the insulator bore in the insulator nose region 74, or forming the abruption 34 along the insulator nose region 74.

The method also includes providing the central electrode 22 formed of the electrically conductive material and the shell 30 formed of the metal material and including the inner shell surface 92 presenting the shell bore extending longitudinally from the lower shell end 76 to the upper shell end 100.

The method next includes disposing the central electrode 22 formed of the electrically conductive material in the insulator bore along the insulator inner surface 56. Next, the insulator 28 is disposed in the shell bore. In one embodiment, the step of disposing the insulator 28 in the shell bore includes inserting the insulator 28 through the shell bore at the upper shell end 100 and sliding the insulator 28 through the shell bore until the insulator nose region 74 passes by the lower shell end 76 and is disposed outwardly of the lower shell end 76. The method next includes forming the shell 30 about the insulator shoulders 68, 72 after disposing the insulator 28 in the shell bore. The forming step typically includes deforming and clamping the upper shell end 100 about the insulator upper should 68, so that the shell 30 rests on the insulator upper shoulder 68, as shown in FIG. 1.

In another embodiment, the step of disposing the insulator 28 in the shell bore includes inserting the insulator 28 through the shell bore at the lower shell end 76 and sliding the insulator 28 through the shell bore. Alternatively, other methods can be used to form the igniter 20.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

ELEMENT LIST

| Element Symbol | Element Name |
|---|---|
| 1 | nose length |
| 20 | igniter |
| 22 | central electrode |
| 24 | corona discharge |

-continued

ELEMENT LIST

| Element Symbol | Element Name |
|---|---|
| 26 | combustion chamber |
| 28 | insulator |
| 30 | shell |
| 32 | insulator outer surfaces |
| 34 | abruption |
| 36 | cylinder head |
| 38 | piston |
| 40 | cylinder block |
| 42 | electrode terminal end |
| 44 | electrode firing end |
| 46 | electrode body portion |
| 50 | firing tip |
| 52 | insulator upper end |
| 54 | insulator nose end |
| 56 | insulator inner surfaces |
| 60 | electrode gap |
| 62 | matrix |
| 64 | insulator first region |
| 66 | insulator middle region |
| 68 | insulator upper shoulder |
| 70 | insulator second region |
| 72 | insulator lower shoulder |
| 74 | insulator nose region |
| 76 | lower shell end |
| 78 | transitions |
| 80 | sharp edge |
| 82 | flank |
| 84 | terminal |
| 86 | first terminal end |
| 88 | second terminal end |
| 90 | sealing layer |
| 92 | inner shell surfaces |
| 94 | shell outer surfaces |
| 96 | threads |
| 98 | igniter slot |
| 100 | upper shell end |
| 104 | shell gap |
| t | local thickness |
| $\alpha$ | flank angle |
| $a_e$ | electrode center axis |
| $D_1$ | insulator first diameter |
| $D_2$ | insulator second diameter |
| $D_e$ | electrode diameter |
| $D_m$ | insulator middle diameter |
| $D_n$ | insulator nose diameter |
| $D_s$ | shell bore diameter |
| $D_t$ | tip diameter |

What is claimed is:

1. A corona discharge ignition system for providing a corona discharge in a combustion chamber containing a mixture of fuel and air, comprising:

a corona igniter for emitting a radio frequency electric field to ionize a fuel-air mixture and provide a corona discharge, said corona igniter comprising:

a central electrode extending longitudinally along a center axis and being formed of an electrically conductive material for receiving the high radio frequency voltage and emitting the radio frequency electric field to ionize the fuel-air mixture and provide said corona discharge, a shell formed of a metal material extending along said central electrode, said shell extending longitudinally from an upper shell end to a lower shell end, an insulator formed of an electrically insulating material disposed between said central electrode and said shell, said insulator including an insulator outer surface facing away from said central electrode and extending longitudinally from an insulator upper end to an insulator nose end and presenting an abruption extending radially outward relative to said central electrode; and the system further including a power source providing a radio frequency voltage of 1,000 to 100,000 volts to said central electrode such that said central electrode provides the radio frequency electric field, and wherein said abruption of said insulator prevents negative ions from forming a conductive path extending from said shell to said central electrode.

2. The system of claim 1 wherein said insulator has an insulator inner surface facing said central electrode and a local thickness extending from said insulator inner surface to said insulator outer surface and wherein said abruption includes an increase in said local thickness in a direction moving from said shell toward said insulator nose end.

3. The system of claim 2 wherein said insulator includes an insulator nose region extending from adjacent said lower shell end to said insulator nose end and wherein said insulator nose region presents said abruption.

4. The system of claim 3 wherein said insulator nose region presents a nose length extending from adjacent said lower shell end to said insulator nose end and said abruption includes an increase of at least 15% in said local thickness over less than 25% of said nose length.

5. The system of claim 4 wherein said abruption includes an increase of at least 25% in said local thickness over less than 25% of said nose length.

6. The system of claim 1 wherein said lower shell end presents an end surface disposed perpendicular to said central axis, said abruption is a flank surface, said insulator includes a notch extending radially toward said central electrode, and said notch includes said flank surface facing said end surface of said shell.

7. The system of claim 6 wherein said flank surface presents a flank angle being greater than 30 degrees.

8. The system of claim 1 wherein said lower shell end presents an end surface disposed perpendicular to said central axis, said abruption is a flank surface, said insulator includes a protrusion extending radially away from said central electrode, and said protrusion includes said flank surface facing said end surface of said shell.

9. The system of claim 8 wherein said flank surface presents a flank angle being greater than 30 degrees.

10. The system of claim 1 wherein said insulator outer surface includes at least one smooth transition providing said abruption.

11. The system of claim 1 wherein said insulator outer surface includes at least one sharp edge providing said abruption.

12. The system of claim 1 wherein said insulator has an insulator nose diameter extending perpendicular to said central electrode and decreasing gradually from adjacent said lower shell end toward said abruption and increasing at said abruption.

13. A method for providing a corona discharge in a combustion chamber containing a mixture of fuel and air, including the steps of:

providing a corona igniter, comprising:

a central electrode formed of an electrically conductive material for receiving a radio frequency voltage and emitting a radio frequency electric field to ionize the fuel-air mixture and provide the corona discharge, a shell formed of a metal material extending longitudinally along the central electrode from an upper shell end to a lower shell end, an insulator formed of an electrically insulating material disposed between the central electrode and the shell, and the insulator including an insulator outer surface facing away from the central electrode and extending longitudinally from an insulator upper end to an insulator nose end and presenting an abruption extending radially outward relative to the central electrode; and providing a radio frequency voltage of 1,000 to 100,000 volts to the central electrode such that the central electrode provides the radio frequency electric field, and wherein the abruption prevents negative ions from forming a conductive path extending from the shell to the central electrode.

14. The method of claim 13 wherein after providing the voltage to the central electrode the insulator has a voltage increasing in a first direction radially from the insulator outer surface toward the central electrode and longitudinally over the insulator outer surface from adjacent the lower shell end toward the insulator nose end to said abruption and the voltage decreasing in said first direction at said abruption.

15. The method of claim 13 wherein after providing the voltage to the central electrode the insulator has an electric field being positive and aligned in a first direction radially from the insulator outer surface toward the central electrode and longitudinally over the insulator outer surface from adjacent the lower shell end toward the insulator nose end and wherein the abruption reverses the electric field such that the electric field becomes aligned in a second direction reverse of the first direction at the abruption.

16. The method of claim 13 wherein after providing the voltage to the central electrode the insulator has a voltage potential gradient aligned in a first direction radially from the insulator outer surface toward the central electrode and longitudinally over the insulator outer surface from adjacent the lower shell end toward the insulator nose end and wherein the abruption reverses the voltage potential gradient such that the voltage potential gradient becomes aligned in a second direction reverse of the first direction at the abruption.

17. The method of claim 13 wherein after providing the voltage to the central electrode the shell and the insulator present a shell gap therebetween filled with an ionized gas including positive ions and negative ions and wherein a plurality of the negative ions move along the insulator outer surface and through the insulating material to the abruption and wherein the abruption repels the negative ions.

18. The method of claim 13 wherein after providing the voltage to the central electrode the central electrode and the insulator present an electrode gap therebetween filled with an ionized gas including positive ions and negative ions and wherein a plurality of the positive ions move along the insulator outer surface and through the insulating material to the abruption and wherein the abruption repels the positive ions.

19. The method of claim 13, wherein the step of providing the corona igniter comprises the steps of:

providing the insulator extending longitudinally along a center axis and including an insulator inner surface presenting an insulator bore and the oppositely facing insulator outer surface each extending longitudinally from the insulator upper end to the insulator nose end, wherein the insulator includes an insulator nose region adjacent the insulator nose end and wherein the insulator outer surface of the insulator nose region presents the abruption extending radially relative to the insulator bore, and wherein the abruption is a flank surface, disposing the central electrode in the insulator bore, providing the shell including an inner shell surface presenting a shell bore extending longitudinally form the lower shell end to the upper shell end, wherein the lower shell end presents an end surface disposed perpendicular to the central axis, and disposing the insulator in the shell bore such that the flank surface of the insulator faces the end surface of the shell.

20. The method of claim 19 wherein the step of disposing the insulator in the shell bore includes inserting the insulator nose region including the abruption through the shell bore at the upper shell end and past the lower shell end.

21. The method of claim 19 including forming the shell about the insulator after disposing the insulator in the shell bore.

* * * * *

UNITED STATES PATENT AND TRADEMARK OFFICE

CERTIFICATE OF CORRECTION

PATENT NO. : 9,041,273 B2
APPLICATION NO. : 13/325362
DATED : May 26, 2015
INVENTOR(S) : John Antony Burrows and James D. Lykowski It is certified that error appears in the above-identified patent and that said Letters Patent is hereby corrected as shown below:

On the Title Page:

Item (57), In the Abstract, line 8:

"a nose length (el)", should read as "a nose length (l)".

In the Specification:

Column 5, Line 16, "a nose length (el)", should read as "a nose length (l)".

Column 5, Line 43, "the nose length (el)", should read as "the nose length (l)".

Column 5, Line 48, "the nose length (el)", should read as "the nose length (l)".

Column 5, Line 55, "the nose length (el)", should read as "the nose length (l)".

Column 5, Line 63, "the nose length (el)", should read as "the nose length (l)".

Column 6, Line 8, "the nose length (el)", should read as "the nose length (l)".

Column 6, Line 43, "the nose length (el)", should read as "the nose length (l)".

Column 7, Line 2, "shell bore diameter D", should read as "shell bore Diameter Ds".

Signed and Sealed this
Eighth Day of March, 2016

Michelle K. Lee

Michelle K. Lee
*Director of the United States Patent and Trademark Office*